US007456803B1

(12) United States Patent
Sievenpiper

(10) Patent No.: US 7,456,803 B1
(45) Date of Patent: Nov. 25, 2008

(54) LARGE APERTURE RECTENNA BASED ON PLANAR LENS STRUCTURES

(75) Inventor: Daniel F. Sievenpiper, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 101 days.

(21) Appl. No.: 11/594,350

(22) Filed: Nov. 7, 2006

Related U.S. Application Data

(62) Division of application No. 10/944,032, filed on Sep. 17, 2004, now Pat. No. 7,154,451.

(60) Provisional application No. 60/470,028, filed on May 12, 2003, provisional application No. 60/470,027, filed on May 12, 2003.

(51) Int. Cl.
*H01Q 15/02* (2006.01)

(52) U.S. Cl. ..... 343/909; 343/700 MS; 343/705; 343/753

(58) Field of Classification Search ..... 343/705, 343/708, 700 MS, 753, 754, 756, 909
See application file for complete search history.

(56) References Cited

U.S. PATENT DOCUMENTS

| | | | | |
|---|---|---|---|---|
| 3,267,480 | A | 8/1966 | Lerner | 343/911 |
| 3,560,978 | A | 2/1971 | Himmel et al. | 343/106 |
| 3,810,183 | A | 5/1974 | Krutsinger et al. | 343/708 |
| 3,961,333 | A | 6/1976 | Purinton | 343/872 |
| 4,045,800 | A | 8/1977 | Tang et al. | 343/854 |
| 4,051,477 | A | 9/1977 | Murphy et al. | 343/700 MS |
| 4,119,972 | A | 10/1978 | Fletcher et al. | 343/844 |
| 4,123,759 | A | 10/1978 | Hines et al. | 343/854 |
| 4,124,852 | A | 11/1978 | Steudel | 343/854 |
| 4,127,586 | A | 11/1978 | Rody et al. | 260/308 B |
| 4,150,382 | A | 4/1979 | King | 343/754 |
| 4,173,759 | A | 11/1979 | Bakhru | 343/100 |
| 4,189,733 | A | 2/1980 | Malm | 343/100 SA |
| 4,217,587 | A | 8/1980 | Jacomini | 343/100 SA |
| 4,220,954 | A | 9/1980 | Marchand | 343/113 R |
| 4,236,158 | A | 11/1980 | Daniel | 343/100 LE |
| 4,242,685 | A | 12/1980 | Sanford | 343/770 |
| 4,266,203 | A | 5/1981 | Saudreau et al. | 333/21 A |
| 4,308,541 | A | 12/1981 | Seidel et al. | 343/786 |
| 4,367,475 | A | 1/1983 | Schiavone | 343/767 |

(Continued)

FOREIGN PATENT DOCUMENTS

DE 196 00 609 A1 4/1997

(Continued)

OTHER PUBLICATIONS

Balanis, C., "Aperture Antennas," *Antenna Theory, Analysis and Design*, 2nd Edition, Ch. 12, pp. 575-597 (1997).

(Continued)

*Primary Examiner*—Tan Ho
(74) *Attorney, Agent, or Firm*—Ladas & Parry

(57) ABSTRACT

A rectenna structure comprising a flexible, dielectric sheet of material; a plurality of metallic lenslets disposed on the sheet of material; and a plurality of diodes disposed on the sheet of material, each diode in said plurality of diodes being arranged at a focus of a corresponding one of said plurality of metallic lenslets.

13 Claims, 7 Drawing Sheets

U.S. PATENT DOCUMENTS

| | | | | |
|---|---|---|---|---|
| 4,370,659 | A | 1/1983 | Chu et al. | 343/772 |
| 4,387,377 | A | 6/1983 | Kandler | 343/756 |
| 4,395,713 | A | 7/1983 | Nelson et al. | 343/713 |
| 4,443,802 | A | 4/1984 | Mayes | 343/729 |
| 4,590,478 | A | 5/1986 | Powers et al. | 343/700 MS |
| 4,594,595 | A | 6/1986 | Struckman | 343/770 |
| 4,672,386 | A | 6/1987 | Wood | 343/770 |
| 4,684,953 | A | 8/1987 | Hall | 343/725 |
| 4,700,197 | A | 10/1987 | Milne | 343/837 |
| 4,737,795 | A | 4/1988 | Nagy et al. | 343/712 |
| 4,749,966 | A | 6/1988 | Tresselt | 343/700 MS |
| 4,760,402 | A | 7/1988 | Mizuno et al. | 343/713 |
| 4,782,346 | A | 11/1988 | Sharma | 343/795 |
| 4,803,494 | A | 2/1989 | Norris et al. | 343/770 |
| 4,821,040 | A | 4/1989 | Johnson et al. | 343/700 MS |
| 4,835,541 | A | 5/1989 | Johnson et al. | 343/713 |
| 4,843,400 | A | 6/1989 | Tsao et al. | 343/700 MS |
| 4,843,403 | A | 6/1989 | Lalezari et al. | 343/767 |
| 4,853,704 | A | 8/1989 | Diaz et al. | 343/767 |
| 4,903,033 | A | 2/1990 | Tsao et al. | 343/700 MS |
| 4,905,014 | A | 2/1990 | Gonzalez et al. | 343/909 |
| 4,916,457 | A | 4/1990 | Foy et al. | 343/770 |
| 4,922,263 | A | 5/1990 | Dubost et al. | 343/797 |
| 4,958,165 | A | 9/1990 | Axford et al. | 343/770 |
| 4,975,712 | A | 12/1990 | Chen | |
| 5,021,795 | A | 6/1991 | Masiulis | 343/700 MS |
| 5,023,623 | A | 6/1991 | Kreinheder et al. | 343/725 |
| 5,070,340 | A | 12/1991 | Diaz | 343/767 |
| 5,081,466 | A | 1/1992 | Bitter, Jr. | 343/767 |
| 5,115,217 | A | 5/1992 | McGrath et al. | 333/246 |
| 5,146,235 | A | 9/1992 | Frese | 343/895 |
| 5,148,182 | A | 9/1992 | Gautier et al. | |
| 5,158,611 | A | 10/1992 | Ura et al. | 106/499 |
| 5,208,603 | A | 5/1993 | Yee | 343/909 |
| 5,218,374 | A | 6/1993 | Koert et al. | |
| 5,235,343 | A | 8/1993 | Audren et al. | 343/816 |
| 5,268,696 | A | 12/1993 | Buck et al. | 342/372 |
| 5,268,701 | A | 12/1993 | Smith | 343/767 |
| 5,278,562 | A | 1/1994 | Martin et al. | 342/1 |
| 5,287,116 | A | 2/1994 | Iwasaki et al. | 343/700 MS |
| 5,287,118 | A | 2/1994 | Budd | 343/909 |
| 5,402,134 | A | 3/1995 | Miller et al. | 343/742 |
| 5,406,292 | A | 4/1995 | Schnetzer et al. | 343/700 MS |
| 5,519,408 | A | 5/1996 | Schnetzer | 343/767 |
| 5,525,954 | A | 6/1996 | Komazaki et al. | 333/219 |
| 5,531,018 | A | 7/1996 | Saia et al. | 29/622 |
| 5,532,709 | A | 7/1996 | Talty | 343/819 |
| 5,534,877 | A | 7/1996 | Sorbello et al. | 343/700 MS |
| 5,541,614 | A | 7/1996 | Lam et al. | 343/792.5 |
| 5,557,291 | A | 9/1996 | Chu et al. | 343/725 |
| 5,581,266 | A | 12/1996 | Peng et al. | 343/770 |
| 5,589,845 | A | 12/1996 | Yandrofski et al. | 343/909 |
| 5,598,172 | A | 1/1997 | Chekroun | |
| 5,600,325 | A | 2/1997 | Whelan et al. | 342/13 |
| 5,611,940 | A | 3/1997 | Zettler | 73/514.16 |
| 5,619,365 | A | 4/1997 | Rhoads et al. | 359/248 |
| 5,619,366 | A | 4/1997 | Rhoads et al. | 359/248 |
| 5,621,571 | A | 4/1997 | Bantli et al. | |
| 5,638,946 | A | 6/1997 | Zavracky | 200/181 |
| 5,644,319 | A | 7/1997 | Chen et al. | 343/702 |
| 5,694,134 | A | 12/1997 | Barnes | 343/700 |
| 5,721,194 | A | 2/1998 | Yandrofski et al. | 505/210 |
| 5,767,807 | A | 6/1998 | Pritchett | 342/374 |
| 5,808,527 | A | 9/1998 | De Los Santos | 333/205 |
| 5,828,344 | A * | 10/1998 | Alder et al. | 343/755 |
| 5,874,915 | A | 2/1999 | Lee et al. | 342/375 |
| 5,892,485 | A | 4/1999 | Glabe et al. | 343/789 |
| 5,894,288 | A | 4/1999 | Lee et al. | 343/770 |
| 5,905,465 | A | 5/1999 | Olson et al. | 343/700 MS |
| 5,923,303 | A | 7/1999 | Schwengler et al. | 343/853 |
| 5,926,139 | A | 7/1999 | Korisch | 343/702 |
| 5,929,819 | A | 7/1999 | Grinberg | 343/754 |
| 5,943,016 | A | 8/1999 | Snyder, Jr. et al. | 343/700 MS |
| 5,945,951 | A | 8/1999 | Monte et al. | 343/700 MS |
| 5,949,382 | A | 9/1999 | Quan | 343/767 |
| 5,966,096 | A | 10/1999 | Brachat | 343/700 MS |
| 5,966,101 | A | 10/1999 | Haub et al. | 343/767 |
| 5,991,474 | A * | 11/1999 | Baldi | 385/15 |
| 6,005,519 | A | 12/1999 | Burns | 343/700 MS |
| 6,005,521 | A | 12/1999 | Suguro et al. | 343/700 MS |
| 6,008,770 | A | 12/1999 | Sugawara | 343/767 |
| 6,016,125 | A | 1/2000 | Johansson | 343/702 |
| 6,028,561 | A | 2/2000 | Takei | 343/767 |
| 6,028,692 | A | 2/2000 | Rhoads et al. | 359/245 |
| 6,034,644 | A | 3/2000 | Okabe et al. | 343/767 |
| 6,034,655 | A | 3/2000 | You | 345/60 |
| 6,037,905 | A | 3/2000 | Koscica et al. | 343/701 |
| 6,040,803 | A | 3/2000 | Spall | 343/700 MS |
| 6,046,655 | A | 4/2000 | Cipolla | 333/137 |
| 6,046,659 | A | 4/2000 | Loo et al. | 333/362 |
| 6,054,659 | A | 4/2000 | Lee et al. | 200/181 |
| 6,061,025 | A | 5/2000 | Jackson et al. | 343/700 MS |
| 6,075,485 | A | 6/2000 | Lilly et al. | 343/700 MS |
| 6,081,235 | A | 6/2000 | Romanofsky et al. | 343/700 MS |
| 6,081,239 | A | 6/2000 | Sabet et al. | 343/753 |
| 6,097,263 | A | 8/2000 | Mueller et al. | 33/17.1 |
| 6,097,343 | A | 8/2000 | Goetz et al. | 343/708 |
| 6,118,406 | A | 9/2000 | Josypenko | 343/700 MS |
| 6,118,410 | A | 9/2000 | Nagy | 343/713 |
| 6,127,908 | A | 10/2000 | Bozler et al. | 333/246 |
| 6,150,989 | A | 11/2000 | Aubry | 343/767 |
| 6,154,176 | A | 11/2000 | Fathy et al. | 343/700 MS |
| 6,166,705 | A | 12/2000 | Mast et al. | 343/853 |
| 6,175,337 | B1 | 1/2001 | Jasper, Jr. et al. | 343/770 |
| 6,175,723 | B1 | 1/2001 | Rothwell, III | 455/63 |
| 6,188,369 | B1 | 2/2001 | Okabe et al. | 343/767 |
| 6,191,724 | B1 | 2/2001 | McEwan | 342/21 |
| 6,198,438 | B1 | 3/2001 | Herd et al. | 343/700 MS |
| 6,198,441 | B1 | 3/2001 | Okabe et al. | 343/702 |
| 6,204,819 | B1 | 3/2001 | Hayes et al. | 343/702 |
| 6,218,912 | B1 | 4/2001 | Mayer | 333/106 |
| 6,218,997 | B1 | 4/2001 | Lindenmeier et al. | 343/725 |
| 6,246,377 | B1 | 6/2001 | Aiello et al. | 343/700 |
| 6,252,473 | B1 | 6/2001 | Ando | 333/105 |
| 6,285,325 | B1 | 9/2001 | Nalbandian et al. | 343/700 MS |
| 6,307,519 | B1 | 10/2001 | Livingston et al. | 343/767 |
| 6,317,095 | B1 | 11/2001 | Teshirogi et al. | 343/785 |
| 6,323,826 | B1 | 11/2001 | Sievenpiper et al. | 343/909 |
| 6,331,257 | B1 | 12/2001 | Loo et al. | 216/13 |
| 6,337,668 | B1 | 1/2002 | Ito et al. | 343/833 |
| 6,366,254 | B1 | 4/2002 | Sievenpiper et al. | 343/700 |
| 6,373,349 | B2 | 4/2002 | Gilbert | 333/126 |
| 6,380,895 | B1 | 4/2002 | Moren et al. | 343/700 MS |
| 6,388,631 | B1 | 5/2002 | Livingston et al. | 343/767 |
| 6,392,610 | B1 | 5/2002 | Braun et al. | 343/876 |
| 6,404,390 | B2 | 6/2002 | Sheen | 343/700 MS |
| 6,404,401 | B2 | 6/2002 | Gilbert et al. | 343/780 |
| 6,407,719 | B1 | 6/2002 | Ohira et al. | 343/893 |
| 6,417,807 | B1 | 7/2002 | Hsu et al. | 343/700 MS |
| 6,424,319 | B2 | 7/2002 | Ebling et al. | 343/911 L |
| 6,426,722 | B1 | 7/2002 | Sievenpiper et al. | 343/700 MS |
| 6,440,767 | B1 | 8/2002 | Loo et al. | 438/52 |
| 6,473,362 | B1 | 10/2002 | Gabbay | 367/119 |
| 6,483,480 | B1 | 11/2002 | Sievenpiper et al. | 343/909 |
| 6,496,155 | B1 | 12/2002 | Sievenpiper et al. | 343/770 |
| 6,515,635 | B2 | 2/2003 | Chiang et al. | 343/834 |
| 6,518,931 | B1 | 2/2003 | Sievenpiper | 343/700 |
| 6,525,695 | B2 | 2/2003 | McKinzie, III | 343/756 |
| 6,538,621 | B1 | 3/2003 | Sievenpiper et al. | 343/909 |
| 6,552,696 | B1 | 4/2003 | Sievenpiper et al. | 343/909 |
| 6,624,720 | B1 | 9/2003 | Allison et al. | 333/105 |
| 6,642,889 | B1 | 11/2003 | McGrath | 343/700 MS |
| 6,657,525 | B1 | 12/2003 | Dickens et al. | 335/78 |
| 6,741,207 | B1 | 5/2004 | Allison et al. | |

| | | | | |
|---|---|---|---|---|
| 6,822,622 | B2 | 11/2004 | Crawford et al. | |
| 6,864,848 | B2 | 3/2005 | Sievenpiper | 343/767 |
| 6,897,810 | B2 | 5/2005 | Dai et al. | |
| 7,026,993 | B2 | 4/2006 | Zhang et al. | |
| 7,154,451 | B1 * | 12/2006 | Sievenpiper | 343/909 |
| 2001/0035801 | A1 | 11/2001 | Gilbert | 333/126 |
| 2002/0036586 | A1 | 3/2002 | Gothard et al. | 342/374 |
| 2003/0112186 | A1 | 6/2003 | Sanchez et al. | |
| 2003/0122721 | A1 | 7/2003 | Sievenpiper | |
| 2003/0193446 | A1 | 10/2003 | Chen | 343/893 |
| 2003/0222738 | A1 | 12/2003 | Brown et al. | |
| 2003/0227351 | A1 | 12/2003 | Sievenpiper | 333/105 |
| 2004/0113713 | A1 | 6/2004 | Zipper et al. | |
| 2004/0135649 | A1 | 7/2004 | Sievenpiper | 333/105 |
| 2004/0227583 | A1 | 11/2004 | Shaffner et al. | 333/32 |
| 2004/0227667 | A1 | 11/2004 | Sievenpiper | 343/700 MS |
| 2004/0227678 | A1 | 11/2004 | Sievenpiper | 343/702 |
| 2004/0228668 | A1 | 11/2004 | Sievenpiper | 343/700 MS |
| 2004/0263408 | A1 | 12/2004 | Sievenpiper et al. | 343/757 |
| 2005/0012667 | A1 | 1/2005 | Noujem | |
| 2006/0044199 | A1 | 3/2006 | Furuhi et al. | |

FOREIGN PATENT DOCUMENTS

| | | | |
|---|---|---|---|
| EP | 0 539 297 | | 4/1993 |
| EP | 1 158 605 | A1 | 11/2001 |
| FR | 2 785 476 | | 5/2000 |
| GB | 1145208 | | 3/1969 |
| GB | 2 281 662 | | 3/1995 |
| GB | 2 328 748 | | 3/1999 |
| JP | 61-260702 | | 11/1986 |
| WO | 94/00891 | | 1/1994 |
| WO | 96/29621 | | 9/1996 |
| WO | 98/21734 | | 5/1998 |
| WO | 99/50929 | | 10/1999 |
| WO | 00/44012 | | 7/2000 |
| WO | 01/73891 | A1 | 10/2001 |
| WO | 01/73893 | A1 | 10/2001 |
| WO | 03/009501 | | 1/2003 |
| WO | 03/098732 | A1 | 11/2003 |

OTHER PUBLICATIONS

Balanis, C., "Microstrip Antennas," *Antenna Theory, Analysis and Design*, 2nd Edition, Ch. 14, pp. 722-736 (1997).

Brown, W.C., "The History of Power Transmission by Radio Waves," *IEEE Transactions on Microwave Theory and Techniques*, vol. MTT-32, No. 9, pp. 1230-1242 (Sep. 1984).

Chen, P.W., et al., "Planar Double-Layer Leaky-Wave Microstrip Antenna," *IEEE Transactions on Antennas and Propagation*, vol. 50, pp. 832-835 (2002).

Chen, Q., et al., "FDTD diakoptic design of a slot-loop antenna excited by a coplanar waveguide," *Proceedings of the 25th European Microwave Conference 1995*, vol. 2, Conf. 25, pp. 815-819 (Sep. 4, 1995).

Fay, P., "High-Performance Antimonide-Based Heterostructure Backward Diodes for Millimeter-Wave Detection," *IEEE Electron Device Letters*, vol. 23, No. 10, pp. 585-587 (Oct. 2002).

Gianvittorio, J.P., et al., "Reconfigurable MEMS-enabled Frequency Selective Surfaces," *Electronic Letters*, vol. 38, No. 25, pp. 1627-1628 (Dec. 5, 2002).

Gold, S.H.,et al., "Review of High-Power Microwave Source Research," *Rev. Sci. Instrum.*, vol. 68, No. 11, pp. 3945-3974 (Nov. 1997).

Jensen, M.A., et al., "Performance Analysis of Antennas for Hand-Held Transceivers Using FDTD," *IEEE Transactions on Antennas and Propagation*, vol. 42, No. 8, pp. 1106-1113 (Aug. 1994).

Koert, P., et al., "Millimeter Wave Technology for Space Power Beaming," *IEEE Transactions on Microwave Theory and Techniques*, vol. 40, No. 6, pp. 1251-1258 (Jun. 1992).

Lee, J.W., et al., "TM-Wave Reduction From Grooves In A Dielectric-Covered Ground Plane," *IEEE Transactions on Antennas and Propagation*, vol. 49, No. 1, pp. 104-105 (Jan. 2001).

Lezec, H.J., et al., "Beaming Light from a Subwavelength Aperture," *Science*, vol. 297, pp. 820-821 (Aug. 2, 2002).

Linardou, I., et al., "Twin Vivaldi Antenna Fed By Coplanar Waveguide," *Electronics Letters*, vol. 33, No. 22, pp. 1835-1837 (1997).

Malherbe, A., et al., "The Compenasation of Step Discontinues in TEM-Mode Transmission Lines," *IEEE Transactions on Microwave Theory and Techniques*, vol. MTT-26, No. 11, pp. 883-885 (Nov. 1978).

Maruhashi, K., et al., "Design and Performance of a Ka-Band Monolithic Phase Shifter Utilizing Nonresonant FET Switches," *IEEE Transactions on Microwave Theory and Techniques*, vol. 48, No. 8, pp. 1313-1317 (Aug. 2000).

McSpadden, J.O.,et al., "Design and Experiments of a High-Conversion-Efficiency 5.8-GHz Rectenna," *IEEE Transactions on Microwave Theory and Techniques*, vol. 46, No. 12, pp. 2053-2060 (Dec. 1998).

Oak, A.C., et al. "A Varactor Tuned 16 Element MESFET Grid Oscillator," *Antennas and Propagation Society International Symposium*. pp. 1296-1299 (1995).

Perini, P., et al., "Angle and Space Diversity Comparisons in Different Mobile Radio Environments," *IEEE Transactions on Antennas and Propagation*, vol. 46, No. 6, pp. 764-775 (Jun. 1998).

Ramo, S., et al., *Fields and Waves in Communication Electronics*, 3rd Edition, Sections 9.8-9.11, pp. 476-487 (1994).

Rebeiz, G.M., et al., "RF MEMS Switches and Switch Circuits," *IEEE Microwave Magazine*, pp. 59-71 (Dec. 2001).

Schaffner, J., et al., "Reconfigurable Aperture Antennas Using RF MEMS Switches for Multi-Octave Tunability and Beam Steering," *IEEE Antennas and Propagation Society International Symposium, 2000 Digest*, vol. 1, of 4, pp. 321-324 (Jul. 16, 2000).

Schulman, J.N., et al., "Sb-Heterostructure Interband Backward Diodes," *IEEE Electron Device Letters*, vol. 21, No. 7, pp. 353-355 (Jul. 2000).

Semouchkina, E., et al., "Numerical Modeling and Experimental Study of A Novel Leaky Wave Antenna," *Antennas and Propagation Society*, IEEE International Symposium, vol. 4, pp. 234-237 (2001).

Sievenpiper, D., et al., "Beam Steering Microwave Reflector Based On Electrically Tunable Impedance Surface," *Electronics Letters*, vol. 38, No. 21, pp. 1237-1238 (Oct. 1, 2002).

Sievenpiper, D., et al., "Eliminating Surface Currents With Metallodielectric Photonic Crystals," *1998 MTT-S International Microwave Symposium Digest*, vol. 2, pp. 663-666 (Jun. 7, 1998).

Sievenpiper, D., et al., "Low-Profile, Four-Sector Diversity Antenna On High-Impedance Ground Plane," *Electronics Letters*, vol. 36, No. 16, pp. 1343-1345 (Aug. 3, 2000).

Sievenpiper. D.F., et al., "Two-Dimensional Beam Steering Using an Electrically Tunable Impedance Surface," *IEEE Transactions on Antennas and Propagation*, vol. 51, No. 10, pp. 2713-2722 (Oct. 2003).

Sor, J., et al., "A Reconfigurable Leaky-Wave/Patch Microstrip Aperture For Phased-Array Applications," *IEEE Transactions on Microwave Theory and Techniques*, vol. 50, No. 8, pp. 1877-1884 (Aug. 2002).

Strassner, B., et al., "5.8-GHz Circularly Polarized Rectifying Antenna for Wireless Microwave Power Transmission," *IEEE Transactions on Microwave Theory and Techniques*,vol. 50, No. 8, pp. 1870-1876 (Aug. 2002).

Swartz, N., "Ready for CDMA 2000 1xEV-Do?," *Wireless Review*, 2 pages total (Oct. 29, 2001).

Vaughan, Mark J., et al., "InP-Based 28 $Gh_z$ Integrated Antennas for Point-to-Multipoint Distribution," *Proceedings of the IEEE/Cornell Conference on Advanced Concepts in High Speed Semiconductor Devices and Circuits*, pp. 75-84 (1995).

Vaughan, R., "Spaced Directive Antennas for Mobile Communications by the Fourier Transform Method," *IEEE Transactions on Antennas and Propagation*, vol. 48, No. 7, pp. 1025-1032 (Jul. 2000).

Wang, C.J., et al., "Two-Dimensional Scanning Leaky-Wave Antenna by Utilizing the Phased Array," *IEEE Microwave and Wireless Components Letters*, vol. 12, No. 8, pp. 311-313, (Aug. 2002).

Wu, S.T., et al., "High Birefringence and Wide Nematic Range Bis-Tolane Liquid Crystals," *Appl. Phys. Lett.*, vol. 74, No. 5, pp. 344-346 (Jan. 18, 1999).

Yang, F.R., et al., "A Uniplanar Compact Photonic-Bandgap(UC-PBG) Structure and Its Applications for Microwave Circuits," *IEEE Transactions on Microwave Theory and Techniques*, vol. 47, No. 8, pp. 1509-1514 (Aug. 1999).

Yang, Hung-Yu David, et al., "Theory of Line-Source Radiation From A Metal-Strip Grating Dielectric-Slab Structure," *IEEE Transactions on Antennas and Propagation*, vol. 48, No. 4, pp. 556-564 (2000).

Bialkowski, M.E., et al., "Electronically steered antenna system for the Australian Mobilesat," IEEE Proc. Microw. Antennas Proag., vol. 143, No. 4, (Aug. 1996).

Bradley, T.W., et al., Development Of Voltage-Variable Dielectric (VVD), Electronics Scan Antenna, Radar 97, (Oct. 14-16, 1997)

Cognard, J., "Alignment of Nematic Liquid Crystals and their Mixtures", Molecular Crystals Supplement Series (Table of Contents), date is not available.

Doane, J.W., et al., "Field Control light scattering from nematic microdroplets," Appl. Phys. Lett. 38 (4) ( Jan. 27, 1986).

Grbic, A., et al., "Experimental verification of backward-wave radiation from a negative refractive index metamaterial," Journal of Applied Physics, vol. 92, No. 10, (Nov. 15, 2002).

Hu, Cheng-Nan, et al., "Analysis and design of large leaky-mode array employing the coupled-mode approach," IEEE Transactions on Microwave Theory and Techniques, vol. 49, No. 4, (Apr. 2001).

Jablonski, W., et al., "Microwave Schottky Diode With Beam-Lead Contacts, "Institute of Electron Technology, date is not available.

Jensen, M.A., et al., "EM Interaction of Handset Antennas and a Human in Personal Communications," Proceedings of the IEEE, vol. 83, No. 1, (Jan. 1995).

Sievenpiper, D., "High-Impedance Electromagnetic Surfaces," dissertation (1999).

Sievenpiper, D., "High-Impedance Electromagnetic Surfaces With a Forbidden Frequency Band," IEEE Transactions on Microwave Theory and Techniques, vol. 47, No. 11, (Nov. 1999).

Yashchyshyn, Y., et al., "The Leaky-Wave Antenna With Ferroelectric Substrate," Institute eof Radioelectronics, date is not available.

* cited by examiner

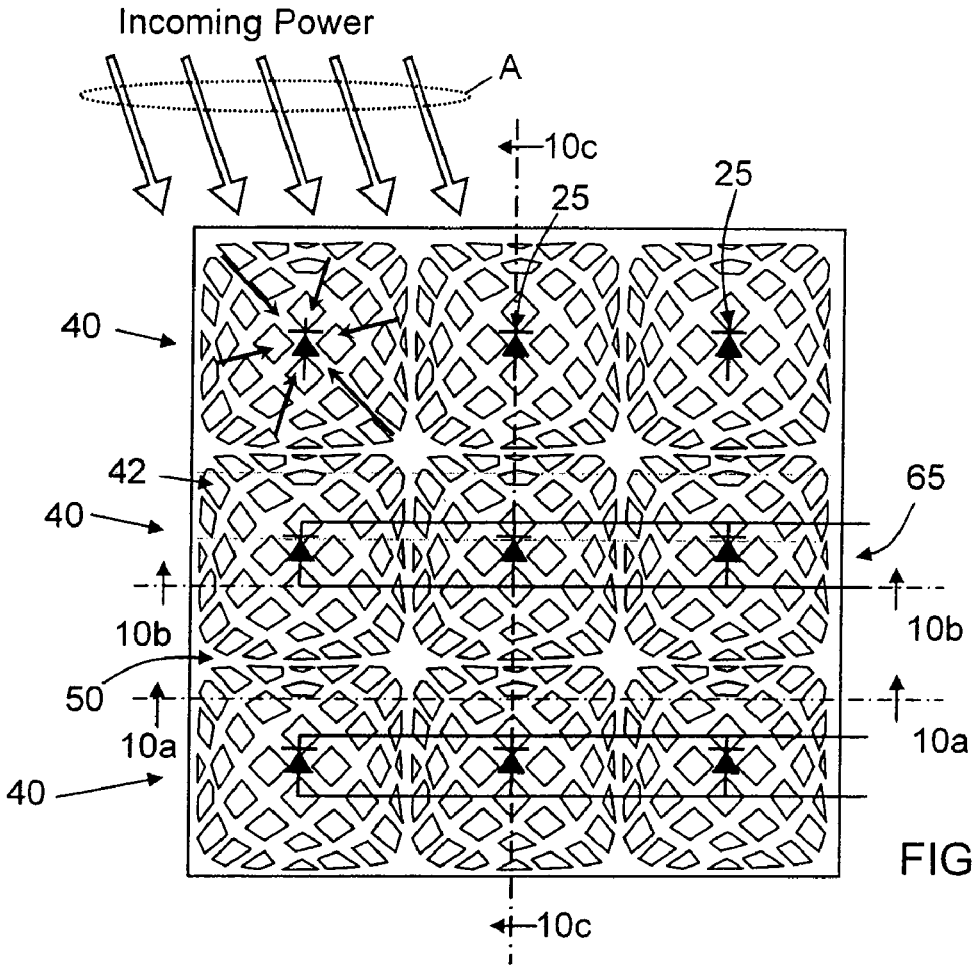
FIG. 10
FIG. 10a
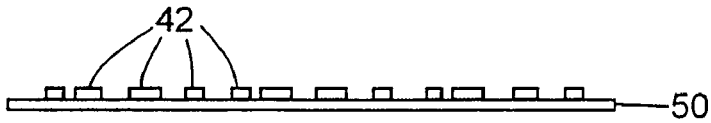
FIG. 10b
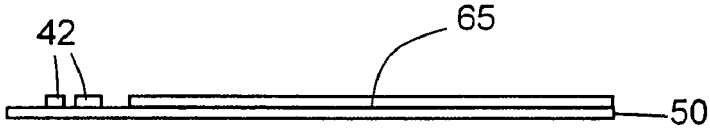
FIG. 10c
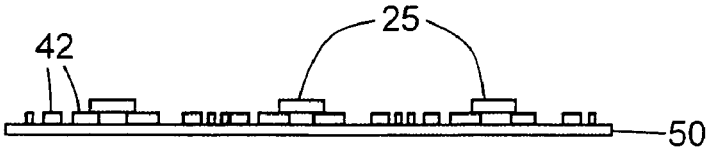

LARGE APERTURE RECTENNA BASED ON PLANAR LENS STRUCTURES

CROSS-REFERENCE TO RELATED APPLICATIONS

This patent application is a divisional application of U.S. application Ser. No. 10/994,032, filed Sep. 17, 2004 now U.S. Pat. No. 7,154,451 which claims the benefit of U.S. Provisional Application Ser. No. 60/470,027 entitled "Meta-element Antenna and Array" filed May 12, 2003 and to U.S. Patent Application Ser. No. 60/470,028 entitled "Steerable Leaky Wave Antenna Capable for Both Forward and Backward Radiation" filed May 12, 2003. The disclosures of these applications are hereby incorporated herein by reference. This disclosure is also related to two non-provisional applications that were filed claiming the benefit of the aforementioned applications. The two non-provisional applications have Ser. Nos. 10/792,411 (now U.S. Pat. No. 7,068,234 issued Jun. 27, 2006) and 10/792,412 and were both filed on Mar. 2, 2004. The disclosures of these two non-provisional applications are also incorporated herein by reference.

TECHNICAL FIELD

The technology disclosed herein relates to a lightweight, high-efficiency rectenna and to a method or architecture for making same. Rectennas can be useful for a variety of applications in the field of beaming RF power, which can be useful for satellites, zeppelins, and UAVs.

BACKGROUND OF THE INVENTION

Rectennas are antenna structures that intentionally incorporate rectifying elements in their designs.

Satellites are an integral part of modern communication systems, and their importance can be expected to grow in the coming years. As future generations of satellites with greater capabilities become possible, it is expected that they can take an even more active role in future military conflicts.

The design of present-day satellites often involves tradeoffs among such aspects as weight, power, and electronic capabilities. Each new electronic system adds weight, and must compete for power with other required systems such as station keeping. The limits of these tradeoffs are eased only gradually from one generation to the next, by the evolution of electronics, batteries, propulsion systems, and so on. Thus, developing new technologies that significantly expand the available design space is crucial to the enablement of satellites with radically improved capabilities over the present generation.

Power supply or generation is one area where revolutionary changes could significantly expand satellite capabilities. Presently, power sources are limited to solar panels or on-board power supplies. Solar panels require continuous exposure to the sun, or the use of batteries to supply power during periods of darkness. Any on-board power system such as a battery adds weight, which reduces the number of electronic systems that can be flown. Furthermore, a system of solar panels and/or on-board sources is best suited to continuous power at moderate levels, and cannot easily supply high-energy bursts without significant additional weight in order to collect and store, and then release the energy.

One way of providing a more flexible power source is to beam the power from a ground station 10 to a satellite 20, as illustrated in FIG. 1. This concept has been explored in the past, but in the opposite direction: beaming power to earth (which seemed attractive during the energy crisis). Sending power in the space to earth direction faces certain fundamental limits that make it impractical, but these limits are eased in the earth to space direction, leading to a system that is within the realm of possibility.

In addition to satellites, there are many other applications where beaming power could be important. For example, it is possible to replace hundreds of civilian cellphone base stations with a single zeppelin 20', shown in FIG. 2, which could service a large metropolitan area 25 with mobile telephony, as well as such other services as "satellite" television. This would provide a low-cost alternative to satellites for many commercial wireless applications.

Furthermore, other applications include small UAVs (Unmanned Aerial Vehicles) that could be powered by beamed energy. See FIG. 3. As the size of a UAV is reduced, the amount of weight that it can carry limits its lifespan significantly. For example, 100-gram airplanes have been built, but their lifetime is limited to six minutes with currently available batteries. By beaming power to a micro-UAV 20", it could stay aloft much longer. This would be useful for such applications as law enforcement, surveillance, hazardous site investigation, etc., in addition to the obvious military applications.

The embodiments of FIGS. 1-3 assume that the source of power is from a ground station 10. However, the source of power need not necessarily be terrestrial. The source of power could be airborne or even in space.

Any beamed power system must confront the fundamental limits summarized by the Friis transmission equation, which relates the total power transmitted to the gain, G, of the transmitting and receiving antennas, the distance between them, R, and the wavelength λ of the radiation used.

$$P_{Rx} = G_{Tx} G_{Rx} \left(\frac{\lambda}{4\pi R}\right)^2 P_{Tx} \quad [1]$$

Assuming for simplicity that both antennas are circular, the gain of each is related to its diameter, D.

$$G = \left(\frac{\pi D}{\lambda}\right)^2 \quad [2]$$

If one assumes for the moment that very little power will be lost to spillover (this requirement can be relaxed) these equations can be combined to yield an expression for the required sizes of the transmitting and receiving antennas, as a function of their separation, and the wavelength of the radiation used. See FIG. 4, which depicts the geometry involved in equation 3, to determine the required diameters for the transmitting and receiving antennas.

$$D_{Tx} D_{Rx} = \frac{4}{\pi} R\lambda \quad [3]$$

For a given separation, reducing the wavelength reduces the size requirements of the transmitter and/or receiver. One tempting solution is to use optical wavelengths, and beam power to space with a large earth-based laser. This has several drawbacks, including scattering by atmospheric turbulence and airborne particles, the typically low wall-plug efficiencies of lasers compared to microwave sources, and the losses in conversion back to DC by photovoltaic cells. Lasers may be viable alternatives for stationary, near-earth applications such as zeppelins, but not for moving applications, such as micro-UAVs. Their utility for satellites is questionable.

The next candidate wavelength range after optical (skipping terahertz frequencies, which are currently not feasible) is millimeter waves. In the 90-100 GHz range, the attenuation for a one-way trip through the atmosphere can be as little as 1 dB (See Koert, 1992, infra). Furthermore, efficient high-power sources are available, such as the gyrotron, which can produce as much as 200 kW of continuous power at millimeter wave frequencies, at an efficiency of 50% (See Gold, 1997, infra). For higher power applications, arrays of klystrons have been proposed that could produce tens of megawatts of power. These existing high-power sources suggest that it could be possible to temporarily supply a satellite with much higher power from the ground than can currently be produced in orbit. For comparison, the most powerful commercial satellite that is available, the Boeing 702, operates at 25 kW from on-board solar panels. These power sources would be more than adequate for airship applications, and the power required for micro-UAVs would only be on the order of watts.

The most significant engineering challenge for efficient earth to space power transmission is the design of the transmitting and receiving antennas. Fortunately, the receiver design is greatly simplified by the development of the rectenna, (See Brown, 1984, infra) which consists of an array having a rectifier diode at each element. Converting to DC directly at each antenna eliminates the requirement for a perfectly flat phase front, and permits the receiving aperture to take any shape. The transmitter must still produce a coherent beam, so a parabolic dish or other method of phase control is necessary. This is one reason why space to earth transmission is impractical. To illustrate the possibility of high-efficiency earth to space transmission, consider the following example.

Assume that 100 GHz radiation is to be used. The maximum transmitter gain is determined by the ability to accurately build a large dish with the necessary smoothness. The Arecibo dish, which operates at 10 GHz, is 300 meters in diameter. First, assume that a 100 GHz dish could be similarly built with a diameter of 30 meters.

Next, assume that a low-earth-orbit (LEO) satellite is utilized, at an altitude of 500 km. Using equation 3, the required receiver diameter for high transmission efficiency is about 60 meters. This can be compared to the Boeing 702 solar panel wingspan of 47 meters. Thus, structures of the required sizes can be built, both on earth and in space.

However, existing rectenna designs are not practical for space power applications because they require an enormous number of diodes to cover such a large area. For the example just described, one diode per half-wavelength at 100 GHz equates to 6 billion diodes. Using 12-inch wafers, and assuming an area of 1 mm square per diode, this represents the yield of 20,000 wafers; the weight and cost of the diodes alone would be prohibitive.

Another problem with space power applications using traditional rectenna designs is that the power density is too low to achieve significant efficiency. The efficiency, h, of a rectenna is related to the voltage across the diodes, $V_D$, and the built-in diode voltage, $V_{bi}$ (See McSpadden, 1998, infra).

$$\eta \propto \frac{1}{1 + V_{bi} / V_D} \quad [4]$$

Designs with efficiencies as high as 90% have been demonstrated, [Strassner, 2002] but the power densities involved were much higher than one could expect to encounter in space. For the LEO example given above, the power density would be 6 mW/cm$^2$, which corresponds to only 0.2 volts generated across each diode—on the order of the typical built-in voltage for a Schottky diode. The practical limitations of a space power system are thus the large number of diodes needed, and the low voltage generated across each diode. The efficiency could also be improved by placing each diode inside a high Q resonant structure, or by using diodes with lower built-in voltage. However, either of these solutions alone would not solve the problem of the large number of required diodes.

As such there is a need for lens-like structures that will allow the number of diodes to be reduced.

In terms of the prior art and a better understanding of the background to the present invention, the reader is directed to the following articles:

W. Brown, "The History of Power Transmission by Radio Waves", *IEEE Transactions on Microwave Theory and Techniques*, vol. 32, no. 9, pp. 1230-1242, September 1984.

P. Fay, J. N. Schulman, S. Thomas III, D. H. Chow, Y. K. Boegeman, and K. S. Holabird, "High-Performance Antimonide-Based Heterostructure Backward Diodes for Millimeter-wave Detection", *IEEE Electron Device Lett.* 23, 585-587 (2002).

S. Gold, G. Nusinovitch, "Review of High Power Microwave Source Research", *Review of Scientific Instruments*, vol. 68, no. 11, pp. 3945-3974, November 1997.

P. Koert, J. Cha, "Millimeter Wave Technology for Space Power Beaming", *IEEE Transactions on Microwave Theory and Techniques*, vol. 40, no. 6, pp. 1251-1258, June 1992.

H. J. Lezec, A. Degiron, E. Devaux, R. A. Linke, L. Martin-Moreno, F. J. Garcia-Vidal, and T. W. Ebbesen, "Beaming Light from a Subwavelength Aperture", *Science*, vol. 297, pp. 820-822, Aug. 2, 2002.

J. McSpadden, L. Fan, K. Chang, "Design and Experiments of a High-Conversion-Efficiency 5.8 GHz Rectenna", *IEEE Transactions on Microwave Theory and Techniques*, vol. 46, no. 12, pp. 2053-2060, September 1984.

J. N. Schulman and D. H. Chow, "Sb-Heterostructure Interband Backward Diodes," *IEEE Electron Device Lett.,* 21, 353-355 (2000).

D. Sievenpiper, J. Schaffner, H. Song, R. Loo, G. Tangonan, "Two-Dimensional Beam Steering Using an Electrically Tunable Impedance Surface", *IEEE Transactions on Antennas and Propagation*, special issue on metamaterials, October 2003.

B. Strassner, K. Chang, "5.8 GHz Circularly Polarized Rectifying Antenna for Wireless Microwave Power Transmission", *IEEE Transactions on Microwave Theory and Techniques*, vol. 50, no. 8, pp. 1870-1876, August 2002.

F. Yang, Y. Qian, T. Itoh, "A Uniplanar Compact Photonic Bandgap (UCPBG) Structure and its Applications for Microwave Circuits", *IEEE Transactions on Microwave Theory and Techniques*, vol. 47, no. 8, pp. 1509-1514, August 1999.

BRIEF DESCRIPTION OF THE INVENTION

Briefly and in general terms, the disclosed technology, in one aspect comprises a rectenna structure comprising: a flexible, dielectric sheet of material; a plurality of metallic lenslets disposed on the sheet of material; and a plurality of diodes disposed on the sheet of material, each diode in said plurality of diodes being arranged at a focus of a corresponding one of said plurality of metallic lenslets.

In another aspect, the disclosed technology relates to a method of generating electrical power for use aboard an aircraft or a satellite, the method comprising: deploying a sheet of dielectric material in an orientation, the sheet of dielectric material being associated with, coupled to and/or forming a part of said aircraft or satellite, the sheet of dielectric material having a plurality of metallic lenslets disposed on the sheet of dielectric material and a plurality of diodes disposed on or adjacent the sheet of dielectric material, each diode in said plurality of diodes being arranged at a focus of a corresponding one of said plurality of metallic lenslets, the diodes being coupled together for supplying electrical power for use by systems aboard said aircraft or a satellite, and directing the orientation of the sheet of dielectric material to receive incident radiation from a source of electromagnetic radiation.

BRIEF DESCRIPTION OF THE FIGURES

FIG. 10 is a plan view of a lightweight, high-efficiency rectenna system based on printed metallic lenslets, and a sparse array of rectifier diodes. The lenslets collect power over many square wavelengths and route it to the diodes. This provides greater power per diode (thus improving efficiency) and also reduces the diode count to a practical number.

FIGS. 10*a*, 10*b* and 10*c* are side elevation views taken through the structure depicted in FIG. 10.

DETAILED DESCRIPTION

A problem in trying to develop a practical earth to space power transmission system is that the voltage across diodes used in a rectenna has not been sufficient in a prior art rectenna to be of practical use to such an application.

Figure 5:
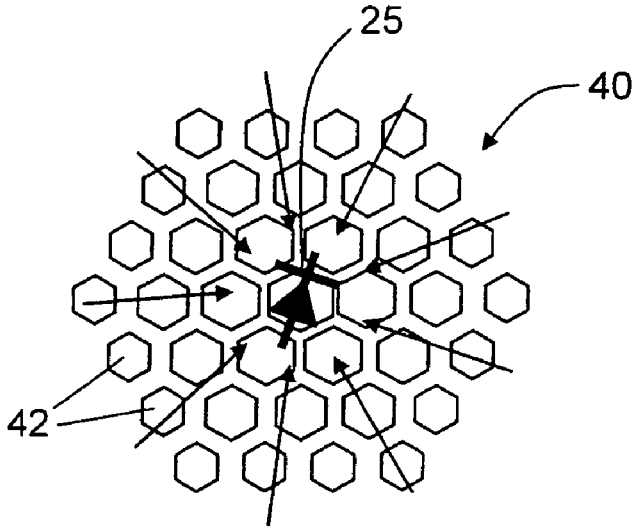
FIG. 5 depicts radiation from a relatively larger being concentrated onto each diode, using, for example, a lightweight, planar resonant structure that may be printed on a thin, flexible plastic film.

However, the voltage across each diode 25 can be increased while reducing the number of diodes by using a lens-like structure or lenslet 40, shown in FIG. 5, to concentrate power from a large area over a small number of diodes 25 in an array of lenslets 40. For example, if one wanted to generate 20 volts across each diode 25, then the incident power from 40 square wavelengths, or a 2-cm diameter area, needs to be collected. This would not only boost the voltage across each diode—and also the diode's efficiency—it would also reduce the number of diodes to about 3 million for the example described above, which equates to about 100 wafers' worth of diodes. Further reductions in the number of diodes required could be achieved with an even larger collection area per diode. Each lenslet 40 comprises a geometric array of electrically conductive patches 42 disposed on a supporting surface. The conductive patches 42 are preferably formed by thin, individual metallic patches formed on a supporting surface, such as, for example, a thin sheet of a plastic material.

Figure 6:
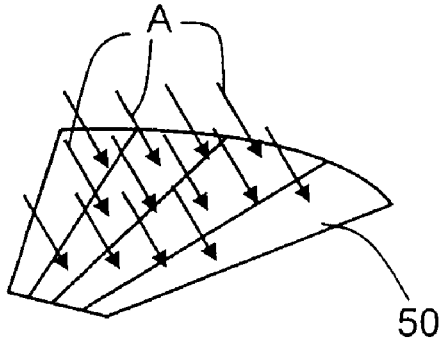
FIG. 6 depicts a large plastic film, printed with metallic lens structures, and populated with rectifier diodes, (not shown) that would serve as a lightweight collector for microwave power. Such a structure could be built to cover tens of meters with minimal weight. The use of printed metallic lenses would reduce the number of diodes, and would increase the voltage across each diode for improved efficiency.

Of course, a traditional dielectric lens would be impractical, but a metallic lens imprinted on a lightweight plastic film 50, which may be unfolded over a large area and could be utilized in a space environment, is practical. This concept for building a practical microwave space power system is illustrated in FIG. 6 where ground-based radiation is represented by arrows A. The thin plastic film 50 would be patterned with sub-wavelength resonant metallic regions or lenslets 40, which would focus the incoming power to a sparse array of diodes 25. Such a film 50 could be made by the tens of meters, but nevertheless would have minimal weight. The metallic lenses would serve the dual purposes of minimizing the number of diodes 25 required, while also improving the efficiency by increasing the voltage across each diode 25.

In accordance with the presently disclosed technology, a structure having a thin plastic film 50 that is covered with a plurality of thin metal patterns, each pattern comprising a plurality of small electrically conductive patches 42 forming a lenslet 40, is disclosed. This technology may be used in applications such as the earth to space power transmission system discussed above. Each metal pattern or lenslet 40 is made such that it behaves as a planar lens, with a focal length of zero. That is, it focuses the incoming power in such a way that a relatively high energy field is created at one point on the surface of the lens 40. The high-energy field has a higher energy than the average energy density of the electromagnetic waves impinging the plastic film 50. The creation of the high-energy fields allows a rectifier diode 25 to be placed at the focus or center of the high-field location, so that all of the power impinging on the lens 40 is rectified by that diode 25. This results in two improvements over existing rectenna designs: (1) It requires far fewer diodes, and (2) it allows the voltage per diode to be higher, which results in more efficient operation. As will be seen, an embodiment of the present invention includes the combination of a planar lens and a sparse array of rectifier diodes to create a lightweight, efficient rectenna.

The design of the planar lens can be summarized as follows: (1) assume that the plastic film 50 is preferably planar and is patterned with metallic or other electrically conductive patches 42 that can be considered as resonators, with a certain resonance frequency. (2) Characterize the patches 42 in terms of scattered field (magnitude and phase) for various frequencies with respect to the resonance frequency. (3) Choose the condition that the fields from all of the metal patches 42 should add up in phase at a single point at the focus of a lens 40, or alternatively choose some other point on the lens. (4) Build a scattering matrix that describes the field at the chosen point on the lens, as a function of the incoming field. This must include the interaction among the various metallic patches. (5) Optimize the resonance frequencies of the metal patches 42 so that the field at the chosen point is a maximum. Of course, diodes 25 would be placed at the focal points of the lenses 40.

Concentrating microwave power from a large area (several tens of square wavelengths) onto a single device, using a thin, patterned metal film can be done in several ways, including by using a non-uniform frequency selective surface (FSS). These structures have been studied for many years for filtering radomes, and other applications. A non-uniform FSS could be designed to have lens-like behavior, and focus incoming waves from a large area onto a single receiving antenna. This is similar to the Fresnel zone plate that is known in optics, but it can have high efficiency because the metal patterns can be designed to provide only a phase shift, with minimal absorption. A series of microwave lenslets 54 could be patterned over a large area of thin plastic film 50, as shown in FIG. 6, to focus the low-density microwave power onto a sparse array of diodes 25.

Figure 7:
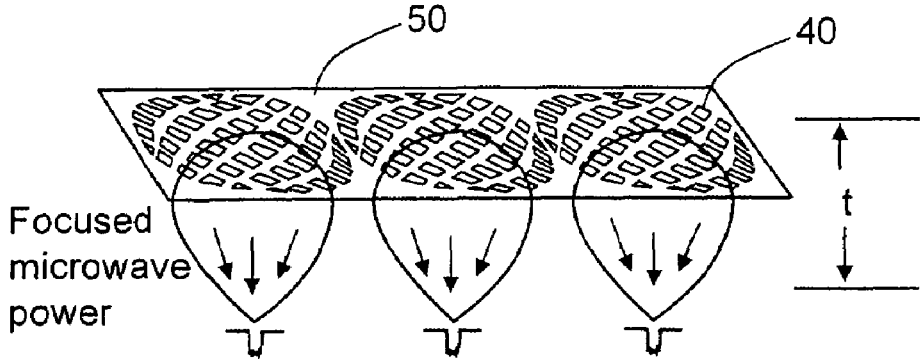
FIG. 7 depicts an embodiment where power is focused onto a sparse array of diodes using a lightweight plastic-film that is patterned with metallic lenses.

One drawback of the traditional FSS approach, shown in FIG. 7, is that it is not uniplanar, because of the need to focus over a distance "t" which would be roughly equal to the diameter of the lenslets 40. It would be difficult to unfold such a structure over an area of many square meters while maintaining the required spacing "t" within suitable tolerances for efficient energy collection.

Figure 8A:
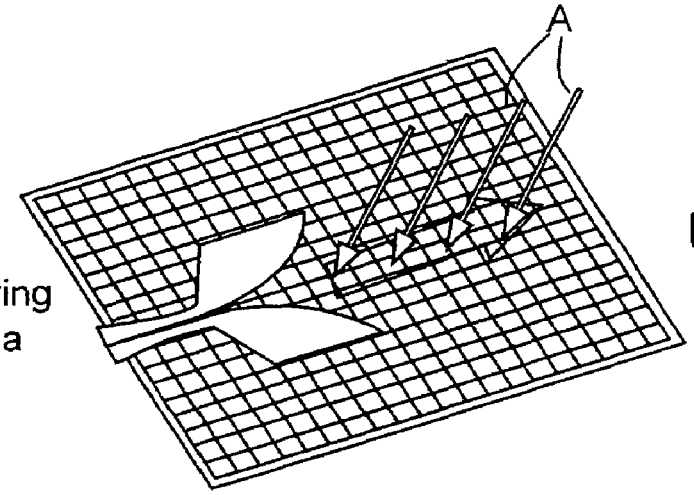
FIG. 8*a* depicts a coplanar antenna on a diode-tuned surface and experiments using such tunable textured surfaces has led the inventor named herein to believe that planar lens structures can focus power onto a coplanar antenna, yielding a completely flat structure.

An alternative is to consider structures where the receiving antennas and the diodes are arranged in a coplanar alignment with the metallic lens structures. This concept has already been demonstrated at HRL Laboratories of Malibu, Calif., through work with tunable, textured electromagnetic surfaces. See, for example, the patent applications mentioned above. A metallic surface texture can be made (through proper optimization) to focus power from many square wavelengths, onto an antenna that is coplanar with the textured surface, as illustrated in FIG. 8. The metallic surface can be quite thin and for most applications, the thinner the metal on the metallic surface the better (due to weight considerations). The experiments at HRL Laboratories involved a diode-tuned impedance surface consisting of many small metallic patches linked by varactor diodes. See the paper by Sievenpiper, 2003, supra, and the patent applications referred to above. Experiments using tunable textured surfaces suggest that planar lens structures can focus power onto a coplanar antenna, yielding a completely (or essentially) flat structure as shown in FIG. 8*a*. The structure of FIG. 8*a* can be made so flat that the antenna and tunable textured surface is nearly imperceptible to one's fingers. Of course, the structures can be more pronounced in some embodiments (so that they would not generally be called flat), but, generally speaking, flat or nearly flat structures would be preferred in most applications, particularly where the plastic film 50 is to be unfolded someplace, such as in space, where human intervention (due to snags and the like), may well not be possible, convenient or desirable.

Figure 8B:
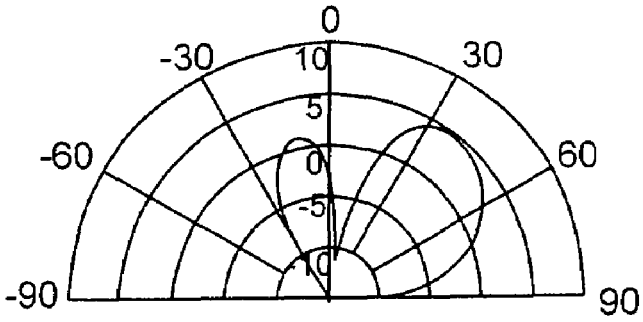
FIG. 8*b* is a graph of the gain for uniform surface impedance.
Figure 8C:
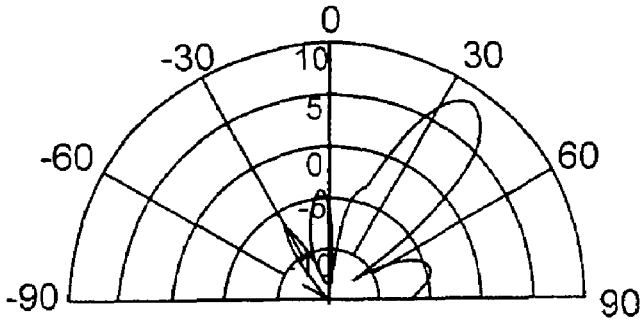
FIG. 8*c* is a graph of the gain for an optimized, non-uniform surface.
Figure 9:
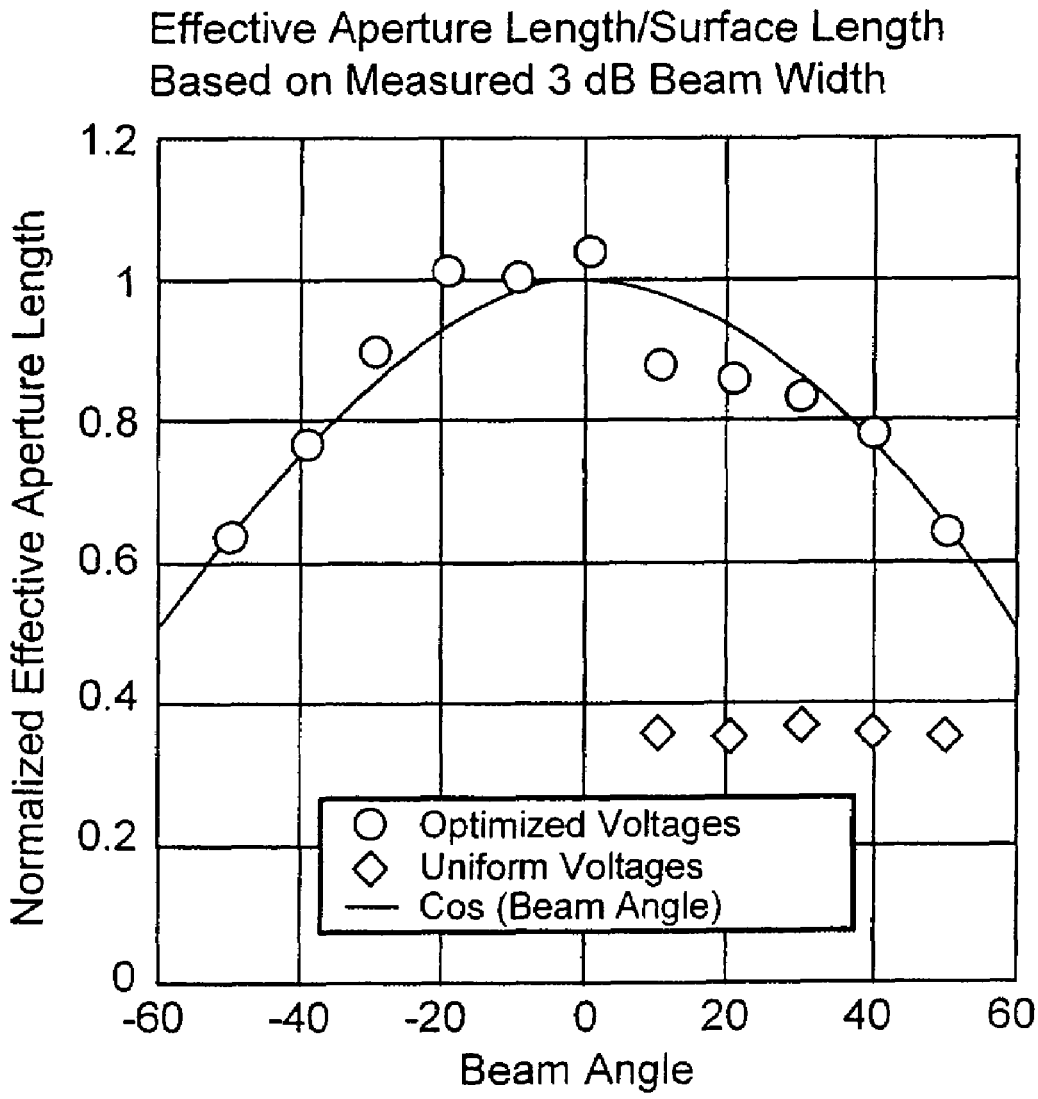
FIG. 9 is a graph depicting the effective aperture for an antenna mounted on an optimized impedance surface can be nearly equal to the entire surface area. The effective aperture size assumes the expected cosine function when optimized for different elevation angles. The effective aperture for a uniform surface is shown for comparison. By optimizing a textured surface, one can make a large-area, planar collector for microwave radiation.

FIG. 8*b* is a graph of the gain for uniform surface impedance while FIG. 8*c* is a graph of the gain for an optimized, non-uniform surface. Using this surface with a coplanar antenna, it was determined that the pattern of capacitance between the metallic patches could be optimized to increase the gain of the antenna mounted on the surface. In this way, the effective aperture size could be extended to cover the entire area of the surface, as plotted in FIG. 9, which indicates that by proper design of a non-uniform impedance surface, power can be collected over a relatively large area (for example a relatively large area may be as large as perhaps hundreds or thousands of square of wavelengths of the impinging radiation), and routed to a single diode on the non-uniform impedance surface for rectification. For RF space power applications, the surface texture would consist of a lattice of fixed capacitors, built into metallized plastic. The capacitors are formed edge to confronting edge of the plates making up each lens. The afore-mentioned capacitors come from the fact that there are small metallic plates that are very close together. These are edge-to-edge capacitors, rather than conventional parallel plate capacitors. Any two conductors that are brought near each other will have some amount of capacitance. A ground plane is not needed here, but it could be used to provide improved efficiency, at the expense of greater weight. The values of the capacitors and the shape of the metal particles would be determined by electromagnetic simulations, and an optimization algorithm.

Figure 1:
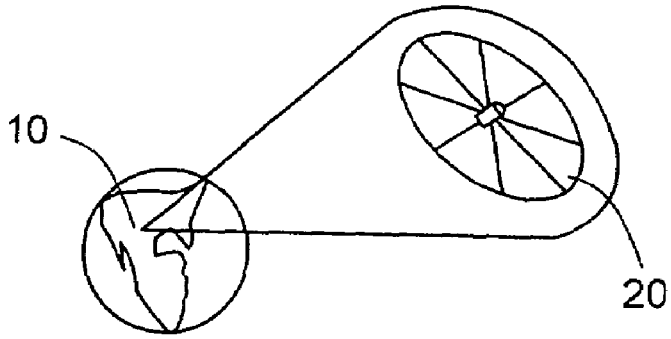
FIG. 1 depicts beaming microwave power to an orbiting satellite as an alternative to the use of traditional solar panels, batteries, and other power sources on the satellite.
Figure 2:
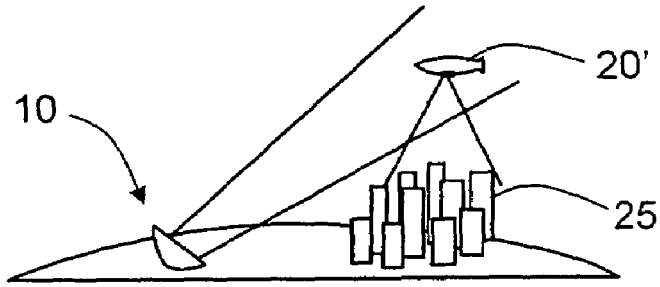
FIG. 2 depicts another application for beamed RF power which includes airships that would supply cities with wireless services, for example.
Figure 3:
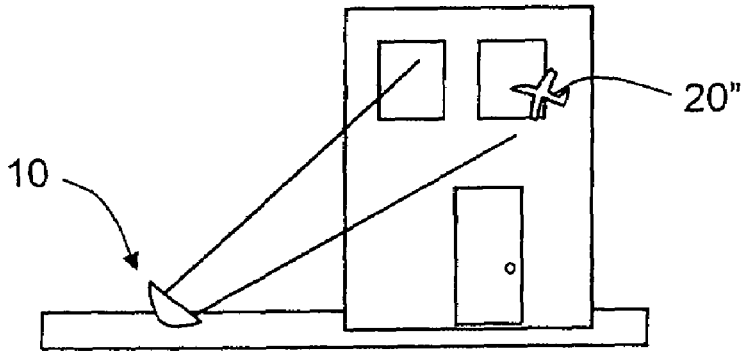
FIG. 3 depicts an application where beamed RF power may also be used to power "slow-flight" micro-UAVs, which could be used for law-enforcement or surveillance, or investigations made at a hazardous site, for example.
Figure 4:
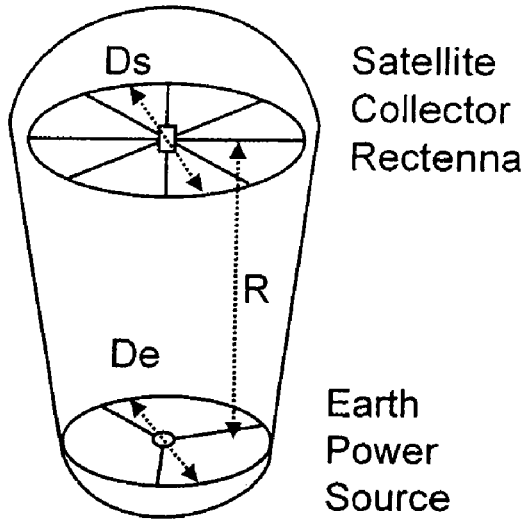
FIG. 4 shows the geometry involved in equation [3], which equation can be used to determine the required diameters for the transmitting and receiving antennas.

The results described above with reference to FIGS. 8*a*-8*c* are for a two-layer structure containing vertical metallic vias—a high-impedance surface—that was built using printed circuit board technology as described in my issued U.S. patents and published U.S. patent applications. Lighter weight structures are needed in order to make this general concept practical and sufficiently lightweight for convenient use in space or even for use on an airship such as the airship shown in FIG. 2. For example, the planar lenslets 40, the collection antennas 60, and the rectifier diodes 25 should preferably be built on a single surface that would preferably be printed on a single-layer plastic, dielectric film. Of significant importance would be the elimination of the vertical vias, and preferably the ground plane itself, leading to an entirely uniplanar structure. Simple uniplanar structures have been studied (See Yang, 1999, supra), but techniques for optimizing complex non-uniform surfaces need to be developed.

Furthermore, if the ground plane is eliminated, methods for minimizing transmission through the structure also would need to be considered. The structure could be analyzed as a complex parasitic array, where the individual patches in the patterned metallic surface could be considered as parasitic antennas. Their shape would be optimized so that the scattered power from each of them would be maximized at one point, where the rectifier diodes would be placed.

A microwave structure embodiment is depicted by FIG. 10. FIGS. 10*a*, 10*b* and 10*c* provide section views through the embodiment depicted by FIG. 10. In this embodiment a lattice of printed metallic lenslets 40, each formed by arrays of thin metal patches 42, focus power onto a sparse array of rectifier diodes 25, which could be coplanar with the lenslets or mounted on the adjacent patches 42 as shown by FIG. 10*c*. DC power lines 65 (which are preferably incorporated into the structure) could then carry power from diodes 25 to the satellite 10, for example, for distribution to the onboard electronic systems. The entire rectenna could be printed on a thin, lightweight, plastic film 50, which could be unfolded to cover an area comprising many square meters. Like all rectennas, it would not need to assume a particular shape, because rectification is done right at each antenna element. However, since each lenslet would provide some directivity, the surface would need to be roughly pointed toward (i.e. be orthogonal to) the source of energy, such as the ground station 10 source. The required pointing accuracy, among other things, would govern the size of the lenslets 40.

Figure 11:
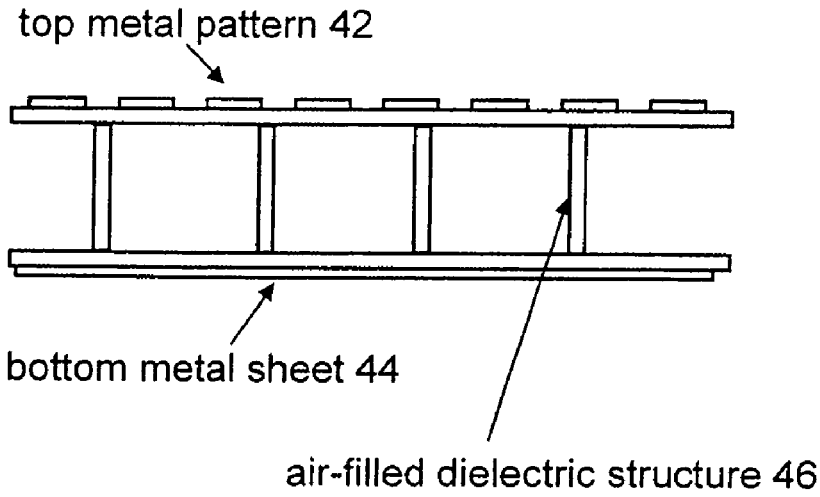
FIG. 11 is a side elevation view of an embodiment with a ground plane spaced from the lenslets using a honeycomb-like structure.

A ground plane may be helpful in some embodiment. It could increase the efficiency, by not allowing any energy to pass through the structure. The metallic pattern on the top of film 50 would be qualitatively similar to that without the ground plane, but in detail it would probably be a different pattern to compensate for the presence of the ground plane. The ground plane would have to be separated from the top metal patterns by some distance, typically 1/100 to 1/10 wavelength, depending on the tolerances allowed in the manufacturing of the metallic patterns. (This is not due to the tolerance of the film thickness. It is due to the fact that the overall thickness will affect the bandwidth. If the bandwidth is very narrow, then the metallic patterns will have to be defined very accurately to get the capacitance right.) In order to allow some spacing, but not to have a very heavy structure, an embodiment with a ground plane 44 may be ribbed, air-filled structure 46, such as that seen in FIG. 11. This might be similar to flexible "bubble wrap", or a rigid honeycomb-like dielectric that is commonly used in airframes and other such things.

In summary, the rectenna consists of a rectifying diode 25 and a generally planar lens structure 40. The lens structure comprises a thin dielectric (such as plastic) sheet 50 that is patterned with metallic regions 42. The metallic regions 42 scatter electromagnetic energy, and they are arranged so that the collective scattered energy from all of them is focused into the diode 25. Each rectifying diode 25 is attached between two adjacent ones of the metal regions 42. The diodes 25 are also attached to long conductive paths 46 (wires) that traverse the entire width of the structure, or are otherwise routed so that they supply current to a common location (such as an edge) where it may be collected and used to supply electrical power to a satellite or other device. The wires 46 are preferably coplanar with the metal patches 42 that make up the lens 40, and they are preferably oriented transverse to the expected polarization of the energizing RF field, so that they have a minimum scattering effect. The metal pattern of the lens 40 can also be optimized to account for the scattering of the wires 46. The lens 40 and indeed the thin dielectric sheet 50 preferably have a planar configuration and indeed the rectenna, when designed, will very likely be assumed to have a planar configuration in order to simplify its design (see the foregoing discussion). But those skilled in the art should appreciate the fact that the sheet 50 may well assume a non-parallel configuration in use, either by design or by accident. If designed for a planar configuration, the extent by which the in-use sheet 50 deviates from a planar configuration will adversely affect its effectiveness. But if the in-use design is close to being planar, the loss in efficiency is likely to be very small. Of course, the rectenna can be designed initially with a non-planar configuration in mind, but a non-planar configuration will doubtlessly complicate finding a desirable arrangement of the patches 42 for the various lenslets 40. Making an assumption that the sheet 50 and the lenslets 40 will all be planar should simplify the design of the rectenna significantly.

The lenses (or lenslets) 40 are ideally designed and optimized using a computer. A random collection of scatterers is simulated, and the collected power is calculated using an electromagnetic solver. The sizes, shapes, and locations of the scatterers are varied according to an optimization method. Such methods are known to those skilled in the art, and include the method of steepest descent, genetic algorithms, and many others. The geometry that provides the greatest power to the diode 25 is then apt to be chosen as the ideal structure.

Such methods are good for determining the best geometry when nothing is known about that geometry beforehand. However, in the case of the present invention, much is known about the required geometry, and one can design a simple structure by hand. The preferred design method is then to start with a known good structure using the calculations described below, and then to optimize it using a computer as described above.

It can be shown that a wave having wave vector $k_0$, propagating on a periodic structure with effective refractive index $n_{eff}$ will be scattered by the periodicity of that structure $k_p$ to an angle θ given by:

$$\theta = \mathrm{Sin}^{-1}\left(\frac{k_0 n_{eff} - k_p}{k_p}\right) \quad [4]$$

The planar lens structure should be designed so that energy scatters from the normal direction (θ=0°) into the plane of the surface where the diode is located. Assuming that the dielectric layer is thin, we have $n_{eff}=1$, so we are left with $k_p=k_0$. Therefore, the periodicity of the structure should be roughly one free-space wavelength.

In order to have independent control over the magnitude and phase of the radiation from the feed point, (or conversely in the present case, the collected energy at the diode 25) it is necessary to have the periodicity be much greater. For independent control over two parameters, the array should be oversampled by a factor of at least two, which means that the individual metal patches 42 should be spaced at most one-quarter wavelength apart, with their properties varying periodically on a length scale of one wavelength. The structure should have close to radial symmetry, so that energy is scattered inward toward a central point. However, the symmetry can vary from perfect radial symmetry to account for polarization effects (leading to a slight deviation which has mirror symmetry) or for practical reasons due to the discrete nature of the individual patches 42. An example of such a structure is shown in FIG. 12.

Figure 12:
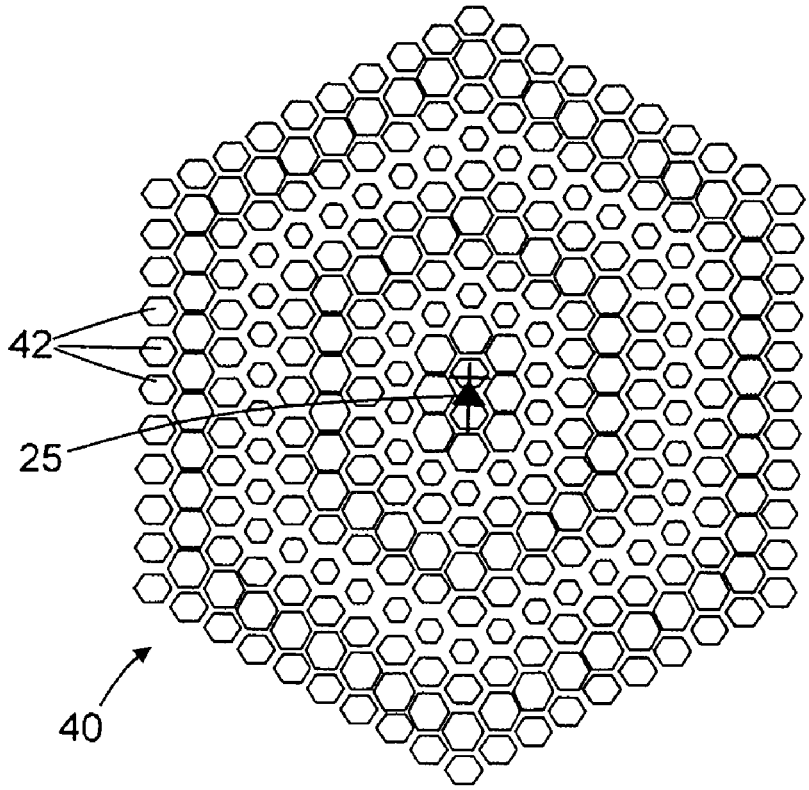
FIG. 12 depicts an array of metal plates with a period of one-quarter wavelength, and features that vary on a length scale of one wavelength, with radial symmetry.

FIG. 12 depicts an array of metal plates 42 located on centers spaced with a period of one-quarter wavelength, and the features thereof (size in this embodiment) vary on a length scale of one wavelength, with radial symmetry. The scattered energy from the metal plates 42 combines coherently at the diode 25 located at the center of the geometric pattern formed by plates 42.

This single planar lens 40 consists of metal patches 42 having a periodicity of one-quarter wavelength, and having properties (the patch size in this embodiment) varying with a period of one wavelength. The planar lens 40 shown has a diameter of about four wavelengths. It collects power over its entire surface, and directs it toward the diode 25 at the center of the pattern, which diode is preferably connected between a pair of the closest patches 42. This lens 40 forms a single element of a larger array 65, shown in FIG. 13, in which the diodes 25 are also connected in parallel by rows.

Figure 13:
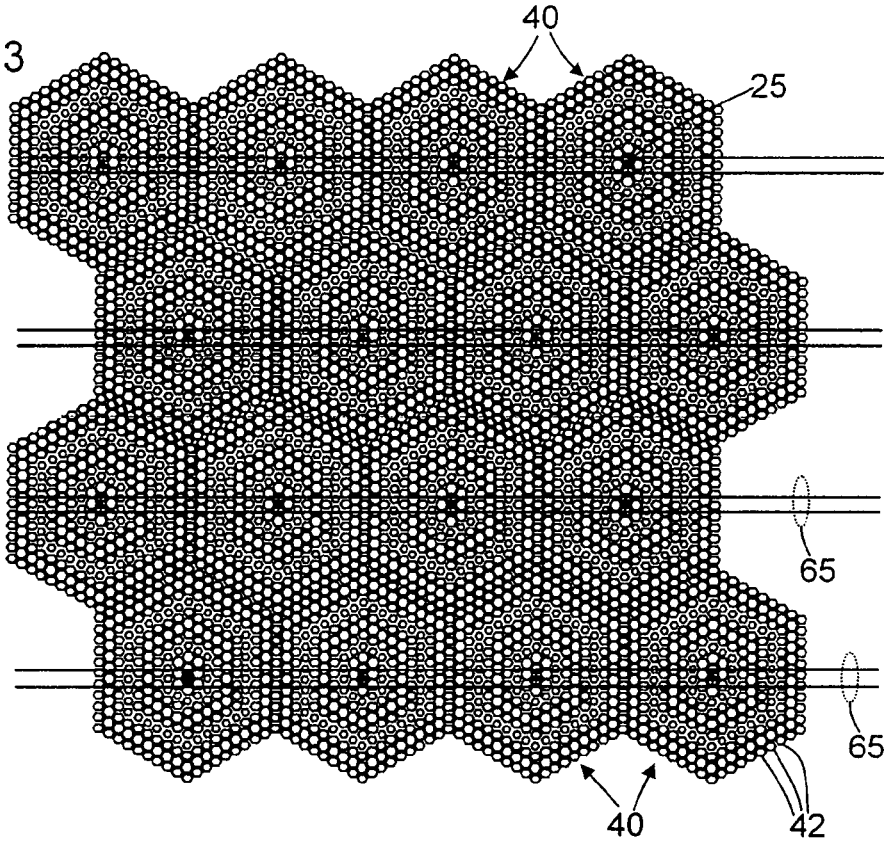
FIG. 13 depicts an array of lenses depicted by FIG. 12, each lens having a diode at its center, with those diodes being connected by DC lines.
Figure 14:
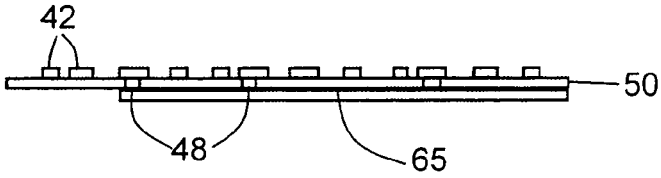
FIG. 14 is similar to FIG. 10*b*, but with a DC line being shown on a reverse side of the dielectric sheet.

FIG. 13 depicts an array of planar lenslets or lenses 30, each having a diode 25 at the center thereof, with those diodes 25 being connected by DC lines 46. The lines are preferably oriented transverse to the electric field of the incoming radiation, so that they do not interfere significantly with the scattered waves. They can be printed on the same side of the sheet 50 (see FIG. 10*b*) as the metallic patches 42, in which case the metal pattern of the lines 46 would simply be combined with that of the patches 42, or they can be printed on the reverse side of sheet 50, and attached to the diodes 25 by small metal plated via holes 48 in the plastic sheet 50, as shown by FIG. 14.

This design requires far fewer diodes than do conventional rectennas, because the diodes 25 are spaced every four wavelengths, rather than every half-wavelength. The result is a factor of close to 64 times reduction in the number of required diodes, and a corresponding factor of 64 times increase in the voltage generated per diode. This is particularly useful in cases where the incoming power density is low (such as space applications), where it would otherwise be difficult to get the induced voltage above the diode threshold voltage. Thus, this design also has higher efficiency due to the greater induced voltage at lower power levels.

Having described this technology in connection with certain embodiments thereof, modification will now doubtlessly suggest itself to those skilled in the art. As such, the protection afforded hereby is not to be limited to the disclosed embodiments except as is specifically required by the appended claims.

What is claimed is:

1. A method of generating electrical power for use aboard an aircraft or a satellite, the method comprising:

a. deploying a sheet of dielectric material in an orientation, the sheet of dielectric material being associated with, coupled to and/or forming a part of said aircraft or satellite, the sheet of dielectric material having a plurality of metallic lenslets disposed on the sheet of dielectric material and a plurality of diodes disposed on or adjacent the sheet of dielectric material, each diode in said plurality of diodes being arranged at a focus of a corresponding one of said plurality of metallic lenslets, the diodes being coupled together for supplying electrical power for use by systems aboard said aircraft or satellite, and b. directing the orientation of the sheet of dielectric material to receive incident radiation from a source of electromagnetic radiation.

2. The method of claim 1 wherein the source of electromagnetic radiation is a terrestrial source of electromagnetic radiation.

3. The method of claim 1 wherein the sheet of dielectric material is deployed in said orientation such that the sheet of dielectric material assumes a planar configuration and is oriented so that the planar configuration is orthogonal to a direction pointing to said source of electromagnetic radiation.

4. The method of claim 3 wherein the source of electromagnetic radiation is a transmitting antenna disposed on or immediately adjacent a surface of the planet earth.

5. The method of claim 4 wherein the metallic lenslets each comprise a geometric arrangement of metallic patches.

6. The method of claim 5 wherein the focus of each lenslet corresponds to a center of the geometric arrangement of metallic patches comprising the lenslet.

7. The method of claim 5 wherein the plurality of lenslets and diodes define a rectenna and wherein the rectenna is designed to be responsive to incident radiation for converting the incident radiation to electrical energy and wherein metallic patches in each of said geometric arrangements have centers which are spaced from centers of neighboring metallic patches by a distance equal to one-quarter wavelength of said incident radiation.

8. The method of claim 7 wherein the patches in each of said lenslets have a property that varies along a radial direction from the focus of the lenslet with a period equal to one wavelength of said incident radiation.

9. The method of claim 8 wherein the property that varies along a radial direction from the focus of the lenslet is the geometric size of the individual patches.

10. The method of claim 9 wherein the geometric arrangement is a hexagonal arrangement.

11. The method of claim 10 wherein the individual patches each have a hexagonal shape when viewed in a plan view.

12. The method of claim 9 wherein the geometric arrangement is a square arrangement.

13. A method of designing an electromagnetic energy receiving surface having a dielectric film with conductive patches formed thereon and arranged as a lens, the receiving surface being responsive to an incoming electromagnetic field, the method comprising:

(1) assume that the dielectric film is preferably planar and is patterned with the conductive patches disposed in a geometric arrangement;

(2) treat the conductive patches as resonators having a resonance frequency;

(3) characterize the metal patches in terms of scattered field (magnitude and phase) for various frequencies with respect to the resonance frequency;

(4) select a shape and a position of the conductive patches such that fields from all of the metal patches add up in phase at a focal point or focus of the lens;

(5) build a scattering matrix that describes the field at a chosen point on the lens as a function of the incoming electromagnetic field, the scattering matrix including interaction among the conductive patches forming the lens; and (6) optimize the resonance frequencies of the conductive patches so that the field at the focal point or focus of the lens is a maximum.

* * * * *